United States Patent [19]

Hutzezon

[11] 4,083,276

[45] Apr. 11, 1978

[54] METHOD FOR CUTTING TOW

[75] Inventor: Frits Hutzezon, Arnhem, Netherlands

[73] Assignee: Akzona Incorporated, Asheville, N.C.

[21] Appl. No.: 714,882

[22] Filed: Aug. 16, 1976

Related U.S. Application Data

[62] Division of Ser. No. 637,806, Dec. 4, 1975, Pat. No. 4,014,231.

[30] Foreign Application Priority Data

Dec. 6, 1974 Netherlands ..... 7415905

[51] Int. Cl.[2] ..... D01G 1/04

[52] U.S. Cl. ..... 83/37; 83/403; 83/913

[58] Field of Search ..... 83/913, 100, 403, 355, 83/356.3, 37

[56] References Cited

U.S. PATENT DOCUMENTS

| | | | |
|---|---|---|---|
| 3,861,257 | 1/1975 | Laird et al. | 83/913 X |
| 3,978,751 | 9/1976 | Farmer et al. | 83/913 X |

*Primary Examiner*—Willie G. Abercrombie

*Attorney, Agent, or Firm*—Francis W. Young; Tom R. Vestal

[57] ABSTRACT

Method and apparatus are disclosed for cutting tow by supplying the tow with a pair of rolls to form a package next to cutting edges inside a rotating ring of blades. A pressure roll forces the tow against the cutting edges which form a surface of rotation preferably at an angle of 5° to 85° to the axis of rotation of the circle of blades.

2 Claims, 2 Drawing Figures

METHOD FOR CUTTING TOW

CROSS REFERENCE TO RELATED APPLICATIONS

This is a divisional application of U.S. Letters Pat. application Ser. No. 637,806, filed Dec. 4, 1975, now U.S. Letters Pat. No. 4,014,231.

BACKGROUND OF THE INVENTION

Synthetic textle yarns such as nylon and polyester, and also rayon yarns, are conveniently spun as a bundle or tow of endless filaments, and cutting the tow into short lengths called staple fibers is a difficult problem, particularly when high rates of production are required, and also where it is necessary to cut the tow into very short staple lengths.

Many types of devices have been devised for cutting a filamentary tow bundle into short lengths. Early conventional cutting processes involved moving the cutting edge slightly lengthwise of the bundle as the cut was made because the bundle was moving lengthwise past the cutting edge during the cut. This sliding movement caused friction which tended to dull the cutting knives and make frequent knife replacement necessary. In addition, friction causes the generation of undesirable heat which, in instances, fuses the ends of synthetic filaments together. Also, the cut surface of the filaments would not be perpendicular to the longitudinal axis, but would be at an angle, because of the continuous longitudinal movement of the filament with respect to the cutting edge of the knife.

Other disadvantages of these early cutters relate to undesired changes in the properties of the material being cut. For instance, the motion of the cutting blades relative to the tow tends to cause undrawn (not crystalline oriented) filaments to be stretched unevenly during cutting. Additionally, the difficulty in correlating two feed speed and cutter blade movement causes a range of lengths to be present in the cut staple — an undesirable property in a number of applications.

One attempt to overcome the disadvantages of prior art cutters is illustrated in U.S. Pat. No. 3,485,120. In this device, knives are mounted around a wheel with the blades extending radially outward. The tow is wrapped under light tension around the wheel and pressure is applied to cut the tow by means of a roller pressing against the outer surface of the tow wrapping as the wheel rotates. However, there are some disadvantages to this arrangement, as the distance between cutting blades is greatest where the cut occurs, and the cut staple does not tend to emerge from between the blades freely for short cut lengths. Also, centrifugal force tends to urge the movement of the cut staple toward the cutting edges, and the staple must be expelled in the opposite direction toward the center of the wheel.

Another apparatus using a somewhat different principle is illustrated in U.S. Pat. No. 3,768,355 which uses a power operated rotatable hollow shaft providing a passageway for the tow, the configuration of the shaft forcing the tow against knives which are arranged radially with their cutting edges pointing inward. This arrangement of knives overcomes some of the disadvantages of the design where the cutting edges pointed outward. However, a disadvantage is that the tow slides against a metal surface thus tending to generate heat by friction, which might cause fusing and/or distortion of filaments at higher speeds. The metal surface is subject to rapid wear and relatively expensive hardened metals must be used in parts of the cutter subject to yarn-to-metal friction. Additionally, the cutting blades are stationary and there is no centrifugal force tending to move the cut staple away from the blades.

Still another apparatus is disclosed in the German Utility Model No. 7,331,413. With this apparatus, the yarn bundle to be cut is fed, while under tension, to a ring of blades and the cage being rotatable relative to each other, and an endless belt is provided on the rolls so that the rolls do not come into direct contact with the yarn bundle.

The construction of this machine is fairly complicated and the apparatus is not very suitable for operation at high speeds.

SUMMARY OF THE INVENTION

This invention relates to a method and apparatus for cutting a tow, continuously supplied by a pair of rotating, positively driven clamping rolls to form a package next to cutting edges inside a rotating ring of blades. A pressure roll forces the tow against the cutting edges which form a surface of rotation at an angle of 5° to 85°, preferably about 60°, to the axis of rotation of the circle of blades. The tow is supplied practically free from tension, and the spinning-in can take place with the blades having a circumferential speed of at least 100 meters per minute. The cut staple is removed clearly from the blades by centrifugal force.

BRIEF DESCRIPTION OF THE DRAWINGS

The invention will now further be described with reference to the appended drawings, in which.

DESCRIPTION OF THE PREFERRED EMBODIMENTS

Figure 1:
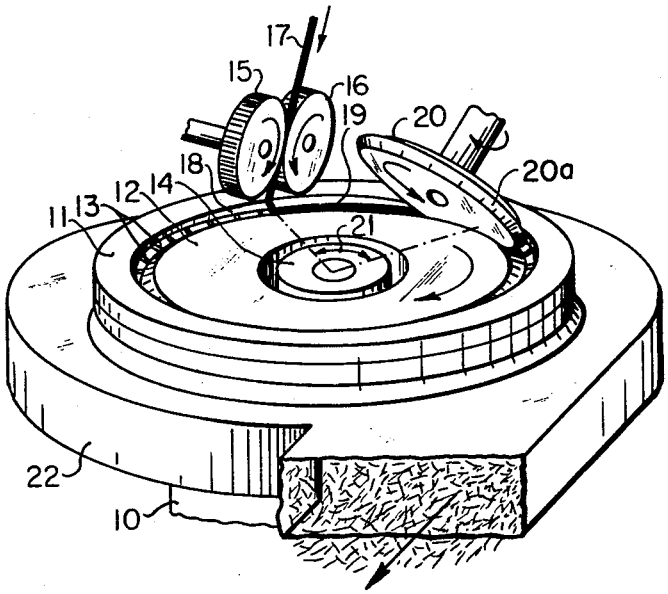
FIG. 1 is a schematic plan view in perspective of the apparatus according to the invention.

In FIG. 1, a frame 10 supports the cutter apparatus and may assume any conventional support device configuration as required and dictated by individual apparatus requirements. A rim 11 and cover plate 12 are concentric with a ring of blades 13 which are spaced around the rim 11 at intervals determined by the length of staple cut desired. The plate 12, rim 11, and blades 13 rotate in conjunction with a hub 14 in the direction shown by the arrow. Over the plate 12 there is a pair of rotatably mounted, driven rollers 15 and 16 having a common tangent line preferably directed to the ring of blades 13 in the direction of rotation of the rollers 15 and 16. Just before and between the rollers 15 and 16 there is positioned a yarn guide (not shown) which serves to feed the tow 17 from a supply source to the rollers 15 and 16 as shown by the arrow.

The tow 17 is laid in a groove 18 located just above the ring of blades 13, which rotates so that with every revolution of the ring of blades 13 one winding of the fed tow 17 is laid on the ring of blades 13 to form a coil 19. The coil 19 of tow 17 is forced against the blades 13 by a rotatably mounted pressure roll 20 rotating in the direction indicated by the arrows and preferably having an axis of rotation intersecting the axis of rotation of the ring of blades 13. The pressure roll 20 may or may not be driven. The pressure roll 20 has an outer surface of rotation **20*a* parallel and adjacent to, but a fixed determined distance away from the cutting edges of the blades 13. The pressure roll 20 is supported free from the plate 12 and is positioned over the plate 12 at an angle 21 measured from the point of introduction of the tow 17. An amply sized, stationary collecting housing 22 for the cut staple surrounds the lower part of the cutter. The housing 22** is provided with an approximately tangentially directed outlet.

Figure 2:
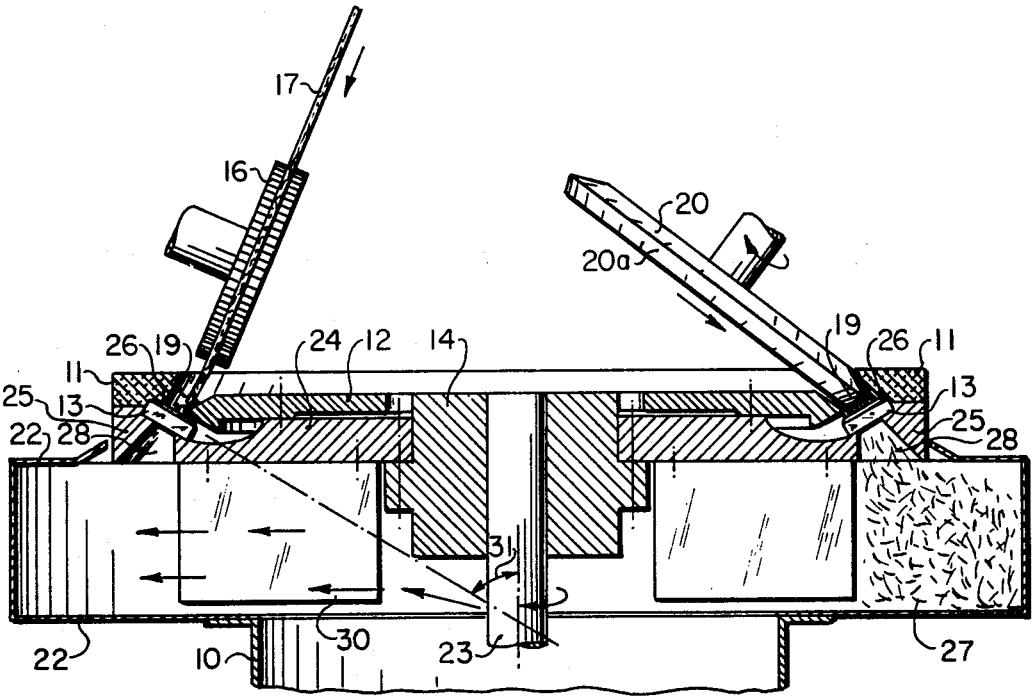
FIG. 2 is a cross-sectional elevational view of the cutter.

In FIG. 2, the shaft 23, driven by means not shown, supports the hub 14, to which is attached the disc 24. On the disc 24 there is provided a ring 25 which is fixedly attached to the disc 24 by means of spokes (not shown). The spokes are located at the points where the blades 13 are also mounted.

The blades 13 are attached with the aid of rim 11 and disc 24. The cutting edges 26 of the blades 13 face upwards.

After a number of revolutions of the ring of blades 13, a number of windings of tow 17 will have been deposited on the ring of blades 13 to form a coil 19 of some thickness. The force applied to the coil 19 by the pressure roll 20 in the direction indicated by the arrow increases with the thickness of the coil 19. When this force is sufficiently great, the coil 19 is at least partly cut on the cutting edges 26 of the blades 13.

The cut fibers 27 subsequently pass through the diverging openings 28 provided between the blades 13, the ring 25, and the disc 24 and are discharged into the stationary collecting housing 22 which encircles radially the ring of blades 13. The cut fibers 27 are withdrawn under the influence of centrifugal force. The withdrawal of the fibers 27 from the housing 22 is augmented by an air stream produced with the fan blades 30 attached radially to the rim 25, disc 24, and ring of blades 13 assembly and opposite the cutting edges 26. The cut fibers 27 are forwarded to a collecting point not shown.

Reference numeral 31 indicates the acute angle between the surface of revolution of the inwardly facing uniform cutting edges 26, the ring of blades 13, and the axis of rotation of the ring of blades 13. This angle may be selected to be 5° - 85°, preferably about 60°.

Viewed in the direction of rotation of the ring of blades 13, the pressure roll 20 is placed at the shortest possible distance past the feed point of the tow 17. It is preferred that the angle 21 (see FIG. 1) between the feed point of the tow 17 at the ring of blades 13 and the pressure point of the pressure roll 20, measured in the direction of rotation of the ring of blades 13, is not more than 180°. According to a preferred embodiment, this angle should be approximately 70°. When no tow coil 19 is presented on the ring of blades 13, the outer circumference of the pressure roll 20 is at a short distance from the surface of revolution generated by the cutting edges 26 of the blades 13 during rotation.

As soon as a tow coil 19 of some thickness has formed on the ring of blades 13 and the coil 19 comes into contact with the pressure roll 20, a force applied by the pressure roll 20 pushes the tow 19 against the blades 13. Additional tow increases the force until sufficient force has been generated to shear the tow 19 in contact with the blades 13. During the cutting process, the ring of blades 13 will continuously remain covered by a tow coil 19.

The special position of the blades and pressure roll prevents filaments in the tow from being shifted relative to each other or from being entangled during their stay in the cutter.

An advantage in the present invention is that the tow to be cut is fed to the ring of blades in such a manner that immediately before it reaches the ring of blades, it is practically free of tension. However, as soon as the tow is positioned on the ring of blades, the centrifugal force of rotation gives rise to a tensile stress which is independent of the layer thickness of the coil on the blades. This practically tensionless feed is realized because the tow is fed to the ring of blades by means of the pair of rotating, positively driven rollers whose point of contact is a relatively short distance from the ring of blades. The threading up of a bundle of tow or a part bundle can be done effectively in that the tow is placed on the ring of blades while it is rotating, for example, at a circumferential speed of 100 meters per minute or more. Threading up can, therefore, be done at production speed without interrupting the tow feeding process. According to this invention, it is possible in a simple manner for tow bundles fed from various points to be assembled before they reach the cutter and be collectively fed to the ring of blades on which they are to be formed into a coil. Also, it is contemplated that additional feed rolls and pressure rolls may be utilized to accommodate additional sources of tow on the same apparatus.

The cut fibers can be discharged in a simple manner on the outside of the ring of blades facing away from the axis of rotation of the ring of blades under the influence of centrifugal force, after the fibers have been cut as a result of the cutting force exerted by the pressure roll positioned within the ring of blades in contact with the roll. Furthermore, the speed at which the tow is fed to the ring of blades is higher than the circumferential speed of the ring of blades measured at its greatest diameter. It is preferred that the feed rate be about 2% to 10% higher.

The apparatus according to the invention is in principle very suitable both for cutting tow into very short fibers having a length of about a few millimeters and for obtaining long fibers having a length, for example, of 20 or 30 centimeters.

What is claimed is:

1. A method for cutting tow from a substantially continuous supply into short lengths of staple, wherein the tow is fed between a rotating ring of cutting knives having radially inward facing cutting edges and a pressure roll having a surface of rotation parallel and adjacent the cutting edges, comprising the step of feeding the tow to the rotating ring at a speed higher than the circumferential speed of the ring of cutting edges measured at their greatest diameter.

2. The method of cutting tow of claim 1 wherein the tow is fed at a speed of about 2% to 10% higher than the circumferential speed of the ring of cutting edges.

* * * * *